US010113307B1

(12) United States Patent
Canby

(10) Patent No.: US 10,113,307 B1
(45) Date of Patent: Oct. 30, 2018

(54) ROLLING BLOCK RESTRAINT CONNECTOR

(71) Applicant: Timothy W. Canby, Irvine, CA (US)

(72) Inventor: Timothy W. Canby, Irvine, CA (US)

( * ) Notice: Subject to any disclaimer, the term of this patent is extended or adjusted under 35 U.S.C. 154(b) by 0 days.

(21) Appl. No.: 15/629,570

(22) Filed: Jun. 21, 2017

(51) Int. Cl.
*E04B 1/41* (2006.01)
*E04B 1/18* (2006.01)

(52) U.S. Cl.
CPC ..... *E04B 1/40* (2013.01); *E04B 1/185* (2013.01)

(58) Field of Classification Search
CPC ..... E04B 1/40; E04B 2001/2424; E04B 1/98; E04B 1/985; E04B 1/185; E04H 9/02
USPC ..... 52/167.1, 167.3, 167.2, 655.1
See application file for complete search history.

(56) References Cited

U.S. PATENT DOCUMENTS 3,268,252 A * 8/1966 Rolland ..... E04B 1/2403 211/182
3,820,293 A * 6/1974 Ohe et al. ..... E04B 1/2604 52/127.12
4,616,950 A * 10/1986 Morris ..... E04B 1/2604 256/65.07
5,505,416 A * 4/1996 Dodge ..... F16L 3/24 248/218.4
5,813,181 A * 9/1998 Ashton ..... E04H 9/02 52/291
6,158,188 A * 12/2000 Shahnazarian ..... E04B 1/2604 403/190
6,862,854 B1 * 3/2005 Fitzmyers ..... E04L 35/14 52/291
6,920,724 B1 * 7/2005 Hundley ..... E04B 1/24 52/167.3
7,117,648 B1 * 10/2006 Pryor ..... E04G 23/0218 52/291
7,299,596 B2 * 11/2007 Hildreth ..... E04B 1/24 52/223.6
8,769,887 B2 * 7/2014 Proffitt, Jr. ..... E04L 32/58 52/167.3
2010/0232872 A1 * 9/2010 Kato ..... E04B 1/2604 403/306
2010/0293880 A1 * 11/2010 Reichartz ..... E04H 12/04 52/651.07

(Continued)

FOREIGN PATENT DOCUMENTS

JP 08226168 A * 9/1996
JP 2010236197 A * 10/2010

OTHER PUBLICATIONS

Machine translation of foreign reference JP 08226168 obtained from https://www4.j-platpat.inpit.go.jp/cgi-bin/tran_web_cgi_ejje?u=http://www4.j-platpat.inpit.go.jp/eng/translation/201802071115550061788045439685715 7B38895D9F78B345C4697853E35CC39F4 (last accessed on Feb. 6, 2018) (Year: 2018).*

(Continued)

*Primary Examiner* — Theodore V Adamos
(74) *Attorney, Agent, or Firm* — Rutan & Tucker, LLP

(57) ABSTRACT

A structural joint connector is formed for two or more intersecting structural members of any material, size or shape, which provides restraint from two channeled pressure blocks to bear on each member. These blocks are fit on two opposing transverse shafts positioned in opposite crossing angles and linked bilaterally parallel to each other to produce a moment resisting couple. The connector has a plurality of applications including providing a means for constructing a wood moment resisting rigid frame and wood portal building frame.

20 Claims, 5 Drawing Sheets

(56) References Cited

U.S. PATENT DOCUMENTS

2011/0047925 A1* 3/2011 Gan ..... E04B 1/2403
52/653.1
2017/0268220 A1* 9/2017 Miller ..... E04L 31/5831

OTHER PUBLICATIONS

Machine translation of foreign reference JP 2010-236197 obtained from https://www4.j-platpat.inpit.go.jp/cgi-bin/tran_web_cgi_ejje?u=http://www4.j-platpat.inpit.go.jp/eng/translation/201802070854266941787196627075055 0B38895D9F78B345C4697853E35CC39F4 (last accessed on Feb. 6, 2018) (Year: 2018).*

* cited by examiner

Fig.1A
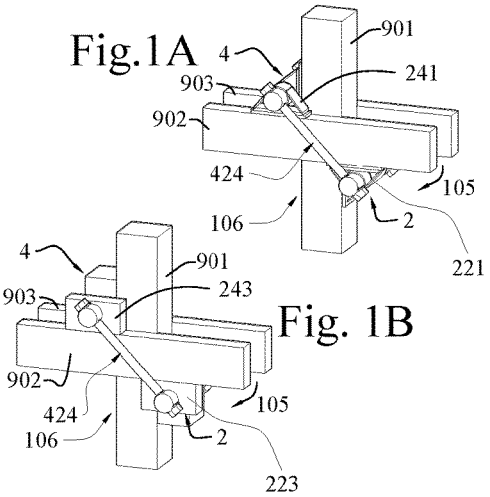
Fig. 1B
Fig. 2
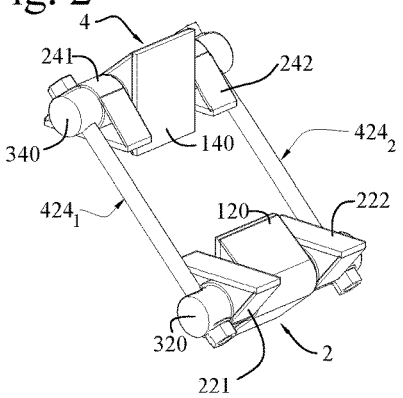
Fig. 3
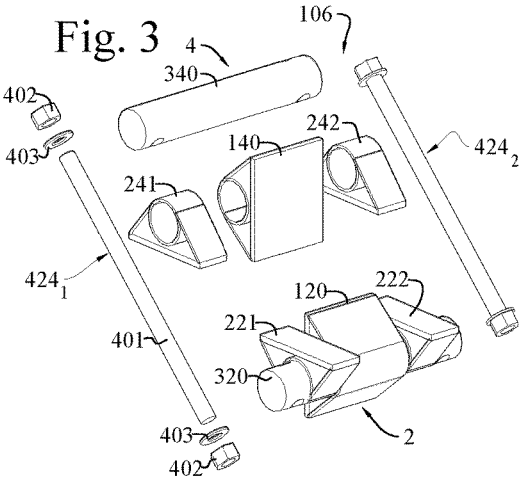
Fig. 4
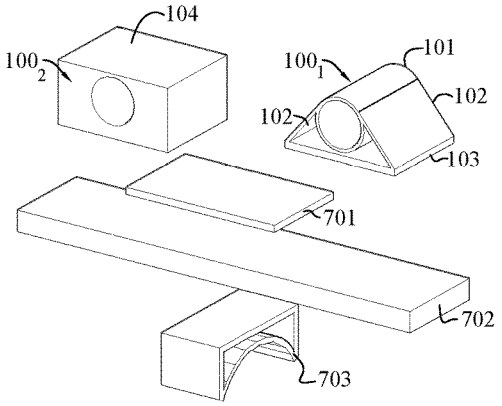
Fig. 5
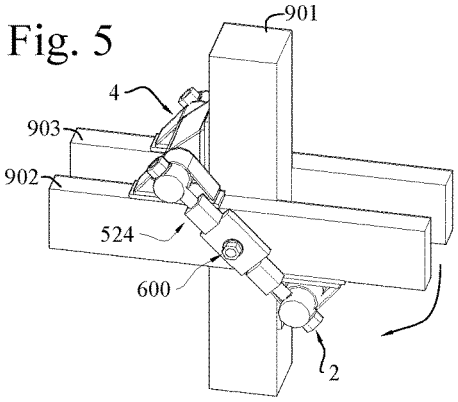
Fig. 6
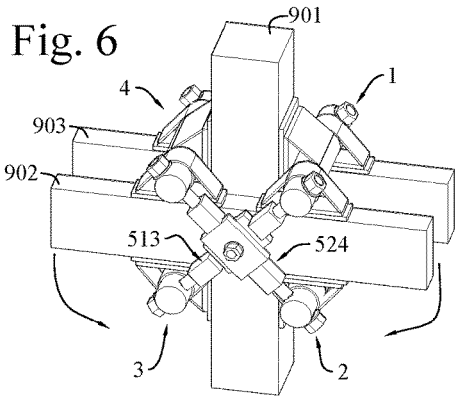

ROLLING BLOCK RESTRAINT CONNECTOR

FIELD

The present invention relates to a connector that is used for the purpose of making structural connections at joints where structural framing members cross and in particular, a joint which resists relative rotation of the members at the connection, such connection being a moment resisting rigid connection which is useful for satisfying many construction framing design requirements.

GENERAL BACKGROUND

Connections are formed and made to hold the structural framing members together to build physical structures such as walls, floors, roofs, towers, bridges, toys, and furniture. Various methods are utilized to form and make connections at the joints where structural framing members cross. Rigid moment connection joints made by processes such as welding, bolting or gluing are time consuming, complicated to make and need to be specifically designed on a case by case basis for the specific materials, size and sectional shapes to be joined. A connector that relies on external forces applied to the outside surface of structural members provides a moment resisting rigid connection independent of size, sectional shape and material joined. Such a connection would be highly valued to the general public for use as an element for structural framing.

BRIEF DESCRIPTION OF THE DRAWINGS

Embodiments of the invention are illustrated by way of example and not by way of limitation in the figures of the accompanying drawings, in which like references indicate similar elements in which:

FIG. 1A shows a first embodiment of a pin-less single RBR connector joining rectangular member.

FIG. 1B shows a second embodiment of a pin-less single RBR connector joining rectangular member.

FIG. 2 shows a pressure block, shaft and linkage parts, assemblies and blow up.

FIG. 3 shows an assembly of a single rolling block restraint (RBR) connector that provides restraint for one rotational direction.

FIG. 4 shows a pressure block and pressure pad inserts.

FIG. 5 shows a pinned single RBR connector joining rectangular member.

FIG. 6 shows a pinned double RBR connector joining rectangular member.

DETAILED DESCRIPTION

Figure 7A:
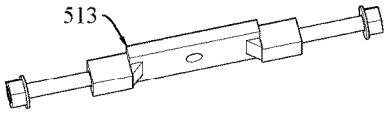
FIGS. 7A and 7B show linkage parts and assembly for a pinned RBR connector.

Some structural member connection types may be referred to as "pinned," which generally means the members are free to rotate. Other structural member connection types may be referred to as moment resisting rigid connections, by which the members are restrained from rotation at the point where they cross and transmit a bending moment through the joint connection. Typical moment resisting rigid connections use a combination of fasteners including screws, bolts, rivets, glue, welding, rods, inserts and/or plates installed at the joint to restrict the rotation and transfer the moment from one member through the connection. These types of connections are time consuming, complicated to make and need to be specifically designed on a case by case basis for the specific materials, size and sectional shapes to be joined and reduce member strength in way of the joint. In contrast, this disclosure provides for a moment resisting rigid connection using a connector that exerts external surface force and thus maintains full member section and strength in way of the joint to eliminate need for supplemental strengthening. Herein, a rolling block restraint (RBR) connector is disclosed that provides rigid restraint to the external surface of a structural member connection.

As used herein, the terms "connector" is generally defined as a device and a "connection" may be the overall joint formed by the use of a connector to couple two or more structural framing members, which that provides moment resisting rigid restraint at the intersection of structural framing members.

The RBR connector is engineered and designed for joining intersecting (e.g., crisscrossing) structural members to provide adequate strength for the forces that will occur at any intersection angle.

A single RBR connector provides a moment resisting rigid connection in one direction. A double RBR connectors with a pin provides a moment resisting rigid connection in both directions such as for a wood moment resisting rigid frame. A RBR connector may be used in forming a connection for: (i) structures that are permanent or temporary, (ii) the erection of a structure, or (iii) the repair of a structure. The members and connections may be reusable. The RBR connector may be configured to restrain 2, 3, 4 or more members as shown in the accompanying figures.

In FIG. 1A, a three member single RBR connector 106 used to restrain main member (MM) 901, side members (SM) SM1 902 and SM2 903 for member forces in a first direction indicated by arrow 105 is shown. The single RBR connector 106 includes the block and shaft assemblies 2 and 4, and two rod linkages $\mathbf{424}_1$ and $\mathbf{424}_2$, as seen in FIGS. 2 and 3. Each of the block and shaft assemblies 2 and 4 includes a plurality of pressure blocks as illustrated in greater detail in, for example, FIGS. 2 and 3. Referring briefly to FIG. 2, the block and shaft assembly 2 is shown to include pressure blocks 221 and 222, which are configured to contact the SM1 902 and the SM2 903, and pressure block 120, which is configured to contact the MM 901. The block and shaft assembly 2 also includes pressure block shaft 320 that passes through a tubular channel (e.g., a cutout) of each of the pressure blocks 120, 221 and 222. Similarly, the block and shaft assembly 4 includes pressure blocks 241 and 242, which are configured to contact the SM1 902 and the SM2 903, pressure block 140, which is configured to contact the MM 901 and pressure block shaft 340 that passes through a tubular channel of each of the pressure blocks 140, 241 and 242. As is further illustrated in FIG. 2, the two rod linkages $\mathbf{424}_1$ and $\mathbf{424}_2$ couple the block and shaft assemblies 2 and 4 such that the pressure blocks 120 and 140 are aligned, the pressure blocks 221 and 241 are aligned, and the pressure blocks 222 and 242 are aligned.

Now referring back to FIG. 1A, the single RBR connector 106 is configured to hold MM 901 and SM1 902 and SM2 903 in place when loaded provided the friction force is greater than external forces. Friction forces occur from the equal and opposite restoring couple forces pressing on the sides of SM1 902 and SM2 903 and MM 901 by the pressure blocks of block and shaft assemblies 2 and 4 and is proportional to the product of static coefficient of friction and the force reaction caused by the load at the point of contact. Additionally, the inward pressures are perpendicular to the surface and in the case of wood grain, this will and increase the strength against some modes of failure. A practical use for this pin-less configuration could be for providing lateral strength resistance when installed between two existing structural columns. Referring now to FIG. 1B, a second embodiment of a pin-less single RBR connector joining rectangular member is shown. The illustration of FIG. 1B illustrates block and shaft assemblies 2 and 4 having rectangular-shaped pressure blocks 243 and 223, in contrast to pressure blocks 241 and 221 of FIG. 1A that include a side having a curved shape.

As shown in FIG. 4, two examples of pressure block assemblies $\mathbf{100}_1$ and $\mathbf{100}_2$. The pressure block assembly $\mathbf{100}_1$ may include a tubular shaft housing 101, connected to two compression struts 102 that are attached to pressure pad 103. The pressure block $\mathbf{100}_2$ may be a single piece of stock and, in some embodiments, may include a tubular channel. The surface area of the pressure pad 103 and insert pad 701 are each sized to distribute acceptable non-crushing bearing pressure to MM 901, SM1 902 and SM2 903, illustrated in FIGS. 1, 5, 6 and 9-21 and discussed below, in order to maintain full sectional strength of these members at the connection when loaded. Component 702 represents an insert for increasing the section modulus and/or changing the characteristic of the joint, such as a length of steel strap to form a composite with wood, or flexible material like neoprene rubber to provide cushion or change coefficient of friction, or a material which will crush when a high load condition occurs to serve as a type of structural fuse. Component 703 represents an insert which has a flat face to interface (e.g., physically contact) with pressure plate 103, component 702, or component 703 and a face shaped to conform to MM 901, SM 902 or SM 903 (e.g., illustrated as a concave face) based on the shape of one MM 901, SM 902 or SM 903. The pressure block design for a wood rectangular member or a steel W section will be different because the bearing capacity of wood is much lower than steel and a steel member is stiffer in way of the webs which necessitates the block be made stronger in that area of bearing.

The pressure blocks 120, 140, 221, 222, 241 and 242 are made of any material such as steel, aluminum or plastic that withstands design loads and by any construction method such as cutting from a solid piece of material, casting, extrusion or fabrication of separate parts. Further, the pressure blocks 120, 140, 221, 222, 241 and 242 need not all be comprised of the same material. The type of block construction shown by $\mathbf{100}_1$ may be made with a gap between parts 101 and 103. A comparison of the gap measured in the unloaded and loaded condition may be used for estimating or calibrating block loading.

Referring to FIG. 3, an exploded view of the components used to form the single RBR connector 106 are shown. FIG. 3 illustrates the two pressure blocks 221 and 241 configured for coupling with SM1 902, two pressure blocks 120 and 140 configured for coupling with MM 901, and two pressure blocks 222 and 242 configured for coupling with SM2 903, pressure block shafts 320 and 340, and two adjustable threaded rod linkages 424. Pressure block shafts 320 and 340 may be solid or tubular such as pipe and have holes made at their ends which may be threaded to receive rod linkages $\mathbf{424}_1$ and $\mathbf{424}_2$. In one embodiment. The rod linkages $\mathbf{424}_1$ and $\mathbf{424}_2$ may be threaded. The pressure block shafts 320 and 340 are inserted through shaft housings 101 on each of the six pressure blocks 120, 140, 221, 222, 241 and 242 as shown in FIG. 2. Adjustable threaded rod linkages $\mathbf{424}_1$ and $\mathbf{424}_2$ include a threaded rod coupling 401, which may be, inter alia, a bolt or threaded rod, linkage nut 402, and linkage washer 403. Linkage washer 403 may be a flat washer or shaped washer that conforms to the shaft surface of contact. Alternatively, the rod linkages $\mathbf{424}_1$ and $\mathbf{424}_2$ may be solid bars and welded to the pressure block shafts 320 and 340 at the ends after the connection is tightened. The block and shaft assemblies 1, 2, 3, and 4 of FIG. 6 each includes three pressure blocks and one shaft corresponding to quadrant 1, 2, 3 and 4 of the connection. For example, assembly 2 is comprised of shaft 320 and pressure blocks 221, 120, and 222. The pressure blocks 221, 120, and 222 rotate freely on the shaft 320 and position the pressure pads 103 in alignment with the member surfaces. For example pressure block 241 rotates on shaft 340 and follows the deflected shape of SM1 as it is loaded. The pressure plate 103 is supported at the ends by compression struts 102 so deflection does not occur over the length of the plate between these supports. As a result, the pressure applied to the member is even and the entire surface of the plate is efficient and easily designed to transfer force less than the crushing strength of the material of the MM and/or SM.

Figure 7B:
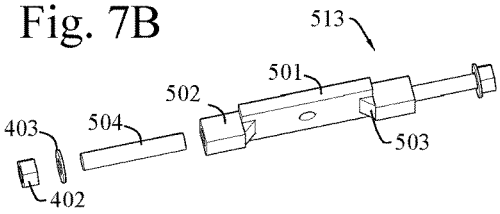
Figure 22:
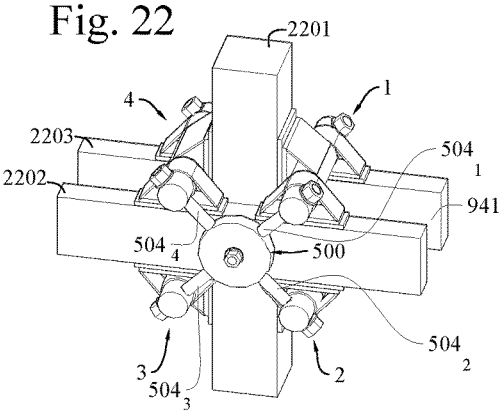
FIG. 22 shows double RBR connectors with a link spoke hub type linkage.

Referring now to FIG. 5, an exemplary illustration in which a pin assembly 600 is installed through the neutral axis of the members. In particular, such an embodiment may be used for conditions where external forces are greater than the friction holding capacity. Briefly referring to FIGS. 8A and 8B, the pin assembly 600 may include a pin 601, a pin housing 602, pin nuts 603 and pin washers 604. In an embodiment of a RBR connector that utilizes the pin assembly 600, the pinned linkages 513 and 524, as shown in FIGS. 7A and 7B, are used in place of the rod linkages $\mathbf{424}_1$ and $\mathbf{424}_2$. Alternatively, a link spoke hub 500, as shown in FIG. 22, could be used in place of the pinned linkages 513 and 524 (e.g., when independent link length adjustments, inserts and member sizes do not change from the linkage crossing angle of the hub design).

Referring to FIG. 6, a double RBR connector which restrains MM 901 and SM1 902 and SM2 903 for loads from either direction is shown. As illustrated in FIG. 6, the double RBR connector uses pressure block assemblies 1 and 3 coupled by bi-lateral pinned linkage assembly 513 and pressure block assembly 2 and 4 coupled by bi-lateral pinned linkage assembly 524 to form the connection. Although not shown, bi-lateral pinned linkage assemblies 513 and 524 are used in a similar manner with respect to the portion of the connection involving SM2 903.

Referring to FIGS. 7A and 7B, pinned linkage assembly 513 is shown. The pinned linkage assembly 513 includes a center link 501 with a hole for a pin 601. In one embodiment, spoke coupling 502 is drilled and tapped for threaded link spoke 504 and is coupled to center link 501 by transition component 503. The combined part including center link 501, spoke coupling 502 and transition component 503 may be a physical connection such as a weldment, a casting, a forging or the like. The thickness of center link 501 may be half the width of spoke coupling 502. In an alternative embodiment, the thickness of the center link 501 may be thinner than half of the width of the spoke coupling 502. Yet in another embodiment, the thickness of the center link 501 may be thicker than half of the width of the spoke coupling 502. In one embodiment, a washer is installed between center link 501 and SM1 903 and the center link 501 and SM2 903 so that all four link spokes 504 will be aligned in the same plane with an extension of their centerline intersecting at a common point. The side surface of center link 501 may be sized according to a size of the spoke coupling 502 and transition component 503 (e.g., so as to avoid interference due to a coupling of the pinned linkage assembly 513 with one or more pinned linkage assemblies).

Figure 8A:
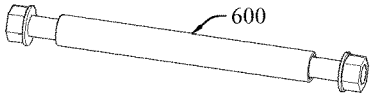
FIGS. 8A and 8B show pin parts and assembly for a pinned RBR connector.
Figure 8B:
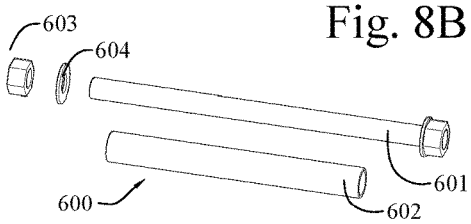

Referring now to FIGS. 8A and 8B, a pin 600 assembly is shown. The pin assembly 600 includes pin 601, pin housing 602, pin nuts 603 and pin washers 604. The pin housing 602 facilitates holding alignment while assembling. The pin housing 602 is sized and designed for the loads, material and section of MM 901 and SM1 902 and SM2 903. For example, the pin housing 602 may be installed as a fabricated weldment for W or C sections. The bending strength loss of MM 901 and SM1 902 and SM2 903 from installing pin housing 602 is relatively small because the material removed from the member in making the hole is close to the neutral axis where bending stress is zero, or substantially zero as is known in the art.

Figure 9:
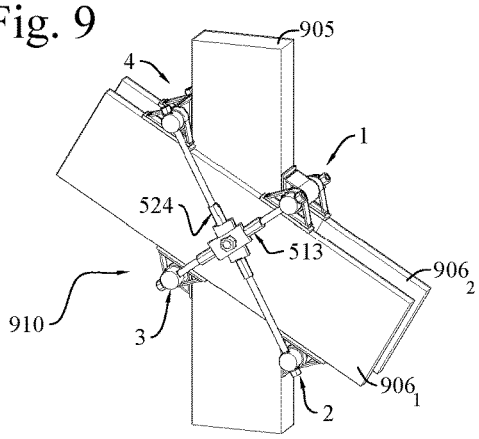
FIG. 9 shows a pinned double RBR connector joining rectangular members at a skewed angle.
Figure 10:
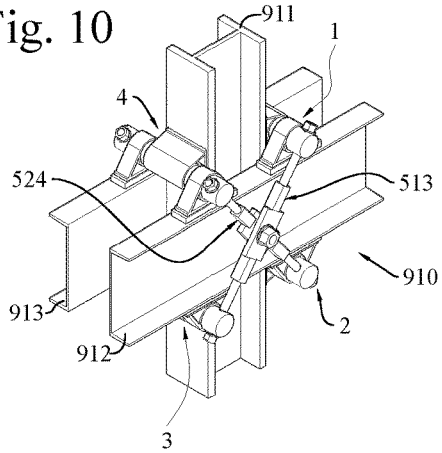
FIG. 10 shows a pinned double RBR connector joining structural steel C and W section members.
Figure 11:
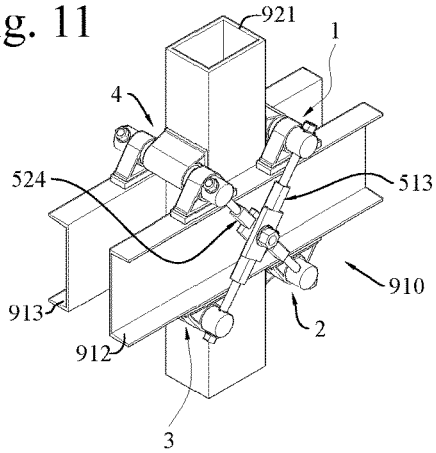
FIG. 11 shows a pinned double RBR connector joining structural steel C and tube steel section members.
Figure 12:
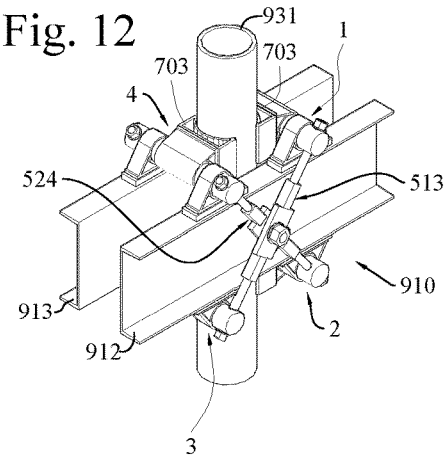
FIG. 12 shows a pinned double RBR connector joining structural steel C and round section members.

Referring to FIG. 9, an embodiment is provided illustrating the flexibility to utilize a double RBR connector for a range of different skew angles is shown. The double RBR connector 910 includes two sets of pinned linkage 513 and 524, which may be adjusted to form the connection illustrated in FIG. 9, e.g., SM1 902 and SM2 903 coupled to the MM 901 at an angle other than 90 degrees, while the components of the pressure block assemblies 1, 2, 3 and 4 remain the same. In the embodiment shown in FIG. 9, the length of the pinned linkage 513 differs from the length of the pinned linkage 524. In one embodiment, the pinned linkages 513 and 524 may have adjustable lengths Referring to FIGS. 10-12, the RBR connector 910 may be used for moment resisting rigid connections with MM and SMs of different sections as shown by: (i) the illustration of FIG. 10, which shows the joining of a MM steel W section 911 with SM steel C sections 912 and 913, (ii) the illustration of FIG. 11, which shows the joining of a MM tube steel section 921 with SM steel C sections 912 and 913, and (iii) the illustration of FIG. 12, which shows the joining of a MM steel pipe section 931 with SM steel C sections 912 and 913. Pipe pad insert 703 provides transition between the flat pressure pad 103 and round pipe surfaces of MM 931 and is also shown in FIG. 1. This is the method for making an RBR connector mate with shapes not having a flat bearing surface.

Figure 13:
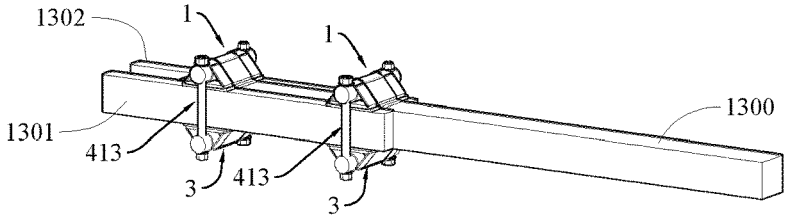
FIG. 13 shows two single RBR connectors spaced longitudinally at an overlapping 3 member joint consisting of rectangular members to form a rigid straight splice between the members.

Referring to FIG. 13, a moment resisting rigid splice using two longitudinally spaced RBR connectors to join rectangular SM1 902 and SM2 903 with rectangular MM 1300 is shown. Such an embodiment is useful for installations that include an adjustable length member.

Figure 14:
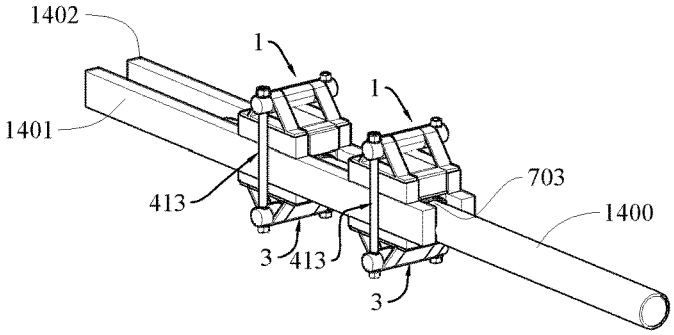
FIG. 14 shows the same connectors as FIG. 13 with the side members rectangular shaped and the main member as a pipe section to form a rigid straight splice connection.

Referring to FIG. 14, a moment resisting rigid splice using two longitudinally spaced RBR connector to join rectangular SM1 902 and SM2 903 with pipe section MM 1400 is shown. Such an embodiment is useful for installations that include a transition from rectangle to pipe or an adjustable length member.

Figure 15:
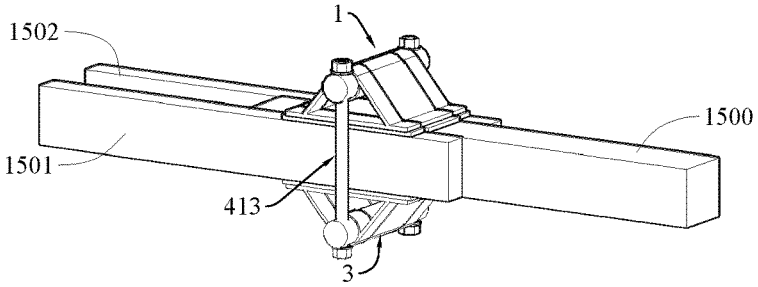
FIG. 15 shows a single RBR connector in straight tightly clamped three member connection.

Referring to FIG. 15, a two direction limiting motion moment resisting rigid splice using one RBR connector to join rectangular SM 1502 and SM 1501 with rectangular MM 1500 is shown. Such an embodiment is useful for installations that include a flexible connection with hard rigid stops as well. The limit of angular rotation is controlled by the adjusted length of threaded rod linkage 413.

Figure 16:
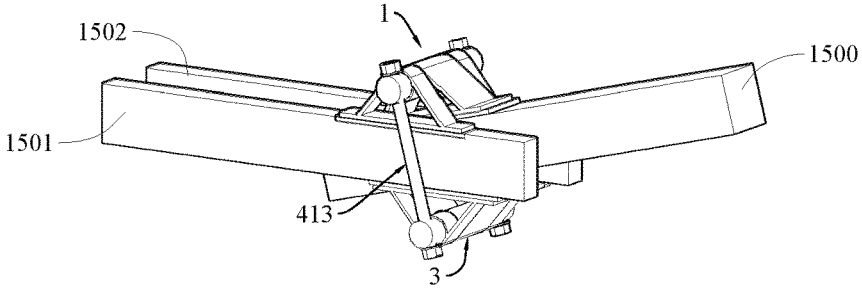
FIG. 16 shows a single RBR connector in skewed angle tightly clamped three member connection.

Referring to FIG. 16, the connection is shown to illustrate limiting motion. The length of threaded rod linkage 413 may be adjusted for MM 1500 to be positioned at an angle with respect to SM 1502 and SM 903.

Figure 17:
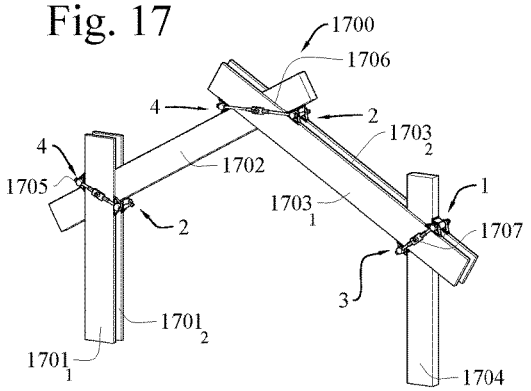
FIG. 17 shows three single RBR connectors joined together to form a gable roof building frame also referred to as portal building frame.

Three RBR connectors are used to construct a frame such as a gable roof rigid building frame, also known as a portal building frame, are shown in FIG. 17. Specifically, a single RBR connector 1700 is used to connect two first columns $\mathbf{1701}_1$-$\mathbf{1701}_2$ to a first gable 1702, the first gable 1702 to two second gables $\mathbf{1703}_1$-$\mathbf{1703}_2$ at a ridge, and the two second gables $\mathbf{1703}_1$-$\mathbf{1703}_2$ to a second column 1704. A double RBR connector, not shown, can be used to provide additional lateral support in the embodiment shown in FIG. 17, or for any single RBR connector shown herein. With portal building frame rigid moment design, the structural member strength is used more efficiently by restraining the structural members at each connection, which allows either greater spans or frame spacing for the same size structural members compared to unrestrained framing.

Figure 18:
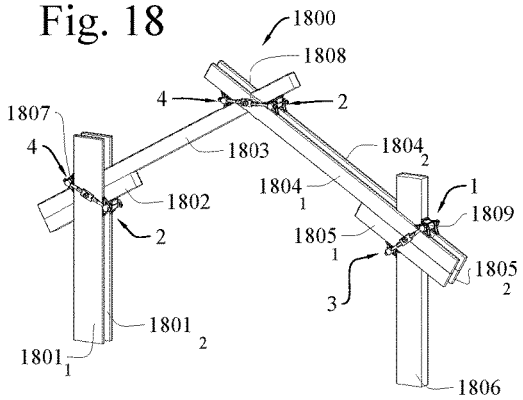
FIG. 18 shows three single RBR connectors joined together to form a portal building frame with reinforced haunches at the column to beam joint.

Referring to FIG. 18, an illustration of three RBR connectors used to construct the portal frame 1800 is shown. Such an embodiment uses a first RBR connector 1807 to connect two first columns $\mathbf{1801}_1$-$\mathbf{1801}_1$ to a first gable 1803 and a first support 1802, a second RBR connector 1808 to connect the first gable 1803 to two second gables $\mathbf{1804}_1$-$\mathbf{1804}_2$ at a ridge, and a third RBR connector 1809 to connect the two second gables $\mathbf{1804}_1$-$\mathbf{1804}_2$ and two second supports $\mathbf{1805}_1$-$\mathbf{1805}_2$ to a second column 1806. The haunch at the roof beam-to-column connection is made deeper to withstand the frame's largest moments that occur in this location. Making the haunch deeper can be done by doubling the beam's depth with the same section of material and adjusting the threaded rod linkages of the second RBR connector 1808 to accommodate the deeper section. Alternatively, a steel strap may be inserted and fastened to one or more structural members to form a composite instead of utilizing an insert between a pressure block and a structural member (e.g., as illustrated by component 702 in FIG. 4).

Figure 19:
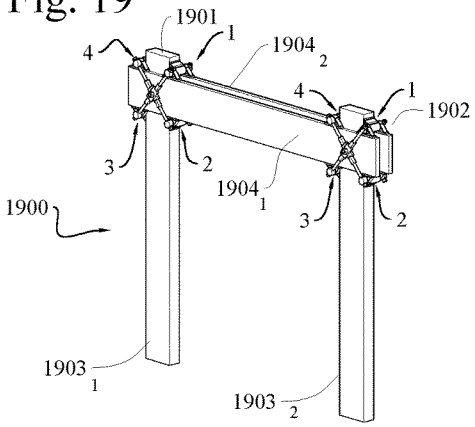
FIG. 19 shows two double RBR connectors joined together to form a moment resisting rigid frame with side members (SM) as header and main member (MM) as columns.
Figure 20:
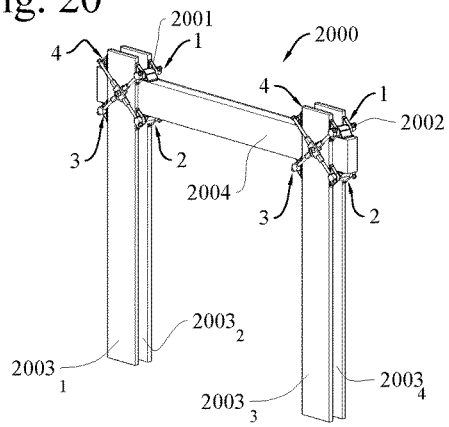
FIG. 20 shows two double RBR connectors joined together to form a moment resisting rigid frame with MM as header and SM as columns.

Two moment resisting rigid frames are shown in FIG. 19 and FIG. 20. Referring to FIG. 19, two double RBR connectors, RBR connector 1901 and RBR connector 1902, are used to form a moment resisting rigid frame 1900. Specifically, MM $\mathbf{1903}_1$-$\mathbf{1903}_2$ are used as columns and SM $\mathbf{1904}_1$-$\mathbf{1904}_2$ are cross beams coupled to the columns via RBR connector 1901 and RBR connector 1902. Referring to FIG. 20, two double RBR connectors, RBR connector 2001 and RBR connector 2002 are used to form a moment resisting rigid frame 2000. Specifically, SM $\mathbf{2003}_1$-$\mathbf{2003}_2$ are used as columns coupled to cross beam MM 2004 by the double RBR connector 2001 and SM $\mathbf{2003}_3$-$\mathbf{2003}_4$ are also used as columns coupled to the cross beam MM 2004 by the double RBR connector 2002.

Figure 21:
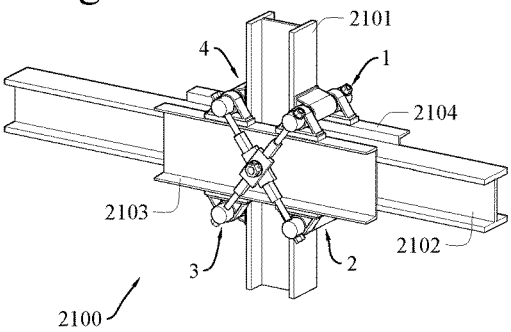
FIG. 21 shows a double RBR connector with structural steel C sections for support of column and beam configuration.

Referring to FIG. 21, an example by which an RBR connector may be configured over a new or existing structure is shown. For example, the coupling of column 2101 and beam 2012 may be an existing structure (e.g., may be lacking in support). In such an embodiment, the double RBR connector 2100 may be configured over the existing coupling along with the insertion of beams 2103 and 2014 to add support to the coupling. Beams 2103 and 2104 may be attached or locked into member beam 2102 as needed based on a case-by-case basis.

Referring to FIG. 22, an exemplary illustration of a link spoke hub 500 is shown. For example, the link spoke hub 500 may be configured to for use when independent link length adjustments, inserts and member sizes do not change from the linkage crossing angle of the hub design. In an alternative embodiment, a pin independent of any linkage may be installed that passes through the column 2201 and the beams 2202 and 2203.

Figure 23:
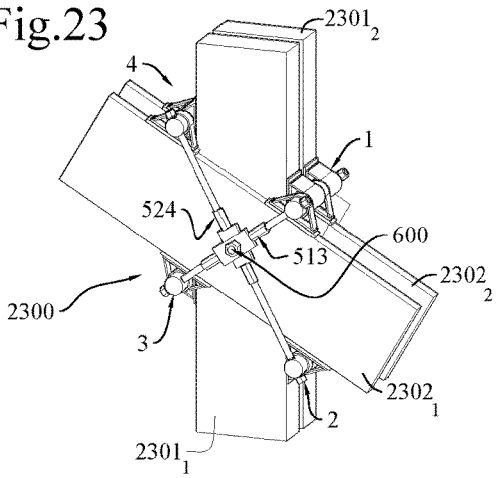
FIG. 23 shows double RBR connectors joining four structural members.

Referring to FIG. 23, an example by which a double RBR connector is used to form a four member connection is shown. Specifically, double RBR connector 2300 includes the block and shaft assemblies 1, 2, 3 and 4, the pinned linkages 513 and 524, and the pin assembly 600. The double RBR connector 2300 is shown as coupling SM $\mathbf{2302}_1$-$\mathbf{2302}_2$ to MM $\mathbf{2301}_1$-$\mathbf{2301}_2$ at a first skew angle.

Figure 24:
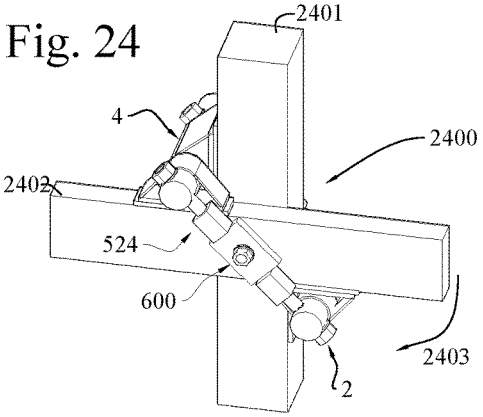
FIG. 24 shows a single RBR connector joining two structural members.

Referring to FIG. 24, an example by which a RBR connector is used to form a two member connection is shown. Specifically, RBR connector 2400 includes the block and shaft assemblies 2 and 4, the pinned linkage 524, and the pin assembly 600. The RBR connector 2400 is shown as coupling MM 2401 to SM 2402 such that member forces are restrained in the direction indicated by arrow 2403.

In the foregoing description, the invention is described with reference to specific exemplary embodiments thereof. It will, however, be evident that various modifications and changes may be made thereto without departing from the broader spirit and scope of the present intention as set forth in the appended claims. For instance, the RBR connector can be made of any material and used by anyone for any assemblies that benefit having rigid connections. Hence, the specification and drawings are accordingly to be regarded in an illustrative rather than in a restrictive sense.

What is claimed is:

1. A rolling block restraint connector for forming a moment resisting connection at a joint intersection between a continuous column and at least a first continuous beam that intersects the continuous column, the connector comprising:

a first restraint assembly including (i) a first beam_pressure block, (ii) a first column pressure block, and (iii) a first tubular shaft that passes through tubular channels of the first beam_pressure block and the first column pressure block;

a second restraint assembly including (i) a second beam_pressure block, (ii) a second column pressure block, and (iii) a second tubular shaft that passes through tubular channels of the second beam_pressure block and the second column pressure block, wherein the second restraint assembly is configured to be located diagonally across the joint intersection from the first restraint assembly;

a first linkage that couples the first restraint assembly with the second restraint assembly, wherein the first linkage passes through a first end of the first tubular shaft and a first end of the second tubular shaft, wherein the first linkage is configured to be located on an exterior of the first continuous beam relative to the joint intersection; and a second linkage that couples the first restraint assembly with the second restraint assembly, wherein the second linkage passes through a second end of the first tubular shaft and a second end of the second tubular shaft.

2. The connector of claim 1, wherein the first restraint assembly includes a third beam pressure block, and wherein the second restraint assembly includes a fourth beam pressure block.

3. The connector of claim 2, wherein the second linkage is configured to be located on an opposite side of the continuous column relative to the first linkage.

4. The connector of claim 2, further comprising:

a third restraint assembly including (i) a fifth beam_pressure block, (ii) a third column pressure block, and (iii) a third tubular shaft that passes through tubular channels of the fifth beam_pressure block and the third column pressure block;

a fourth restraint assembly including (i) a sixth beam pressure block, (ii) a fourth column pressure block, and (iii) a fourth tubular shaft that passes through tubular channels of the sixth beam pressure block and the fourth column pressure block, wherein the fourth restraint assembly is located diagonally across the joint intersection from the third restraint assembly;

a third linkage that couples the third restraint assembly with the fourth restraint assembly, wherein the third linkage passes through a first end of the third tubular shaft and a first end of the fourth tubular shaft; and a fourth linkage that couples the third restraint assembly with the fourth restraint assembly, wherein the fourth linkage passes through a second end of the third tubular shaft and a second end of the fourth tubular shaft.

5. The connector of claim 4, wherein the third restraint assembly includes a seventh beam_pressure block, and wherein and the fourth restraint assembly includes an eighth beam pressure block.

6. The connector of claim 1, wherein the first column pressure block is configured to contact an exterior of the continuous column.

7. The connector of claim 6, wherein the second column pressure block is configured to contact the exterior of the continuous column opposite the first column pressure block.

8. The connector of claim 1, wherein the first column pressure block has a rectangular shape.

9. The connector of claim 1, wherein the first column pressure block includes a curved surface configured to contact the continuous column and a flat surface configured to contact the first continuous beam.

10. The connector of claim 1, further comprising:

a beam insert configured for placement in between the first continuous beam and the first beam_pressure block, the beam insert including a flat side and a concave side, wherein the concave side is configured to contact a rounded portion of the first continuous beam.

11. The connector of claim 1, further comprising:

a column insert configured for placement in between the continuous column and the first column pressure block, the column insert including a flat top and a concave bottom, wherein the concave bottom is configured to contact a rounded portion of the continuous column.

12. The connector of claim 1, wherein the first linkage comprises a rod linkage.

13. The connector of claim 1, wherein the first linkage comprises a pinned linkage.

14. The connector of claim 13, further comprising:

a pin assembly including a pin and two pin nuts, wherein the pin passes through a channel of each of the continuous column and the first continuous beam, and the pin is held in place by a pin nut at each end of the pin.

15. A method for installing a rolling block restraint connector to form a moment resisting connection at a joint intersection between a continuous column and at least a first continuous beam that intersects the continuous column:

placing a first restraint assembly at the joint intersection, wherein the first restraint assembly includes (i) a first beam_pressure block, (ii) a first column pressure block, and (iii) a first tubular shaft that passes through tubular cutouts of the first beam_pressure block and the first column pressure block;

placing a second restraint assembly at the joint intersection, wherein the second restraint assembly includes (i) a second beam_pressure block, (ii) a second column pressure block, and (iii) a second tubular shaft that passes through tubular cutouts of the second beam_pressure block and the second column pressure block, wherein the second restraint assembly is located diagonally across the joint intersection from the first restraint assembly; and coupling the first restraint assembly with the second restraint assembly via a first linkage, wherein the first linkage passes through a first end of the first tubular shaft and a first end of the second tubular shaft.

16. The method of claim 15, wherein the first restraint assembly includes a third beam pressure block, wherein the second restraint assembly includes a fourth beam pressure block, and wherein a second linkage passes through a second end of the first tubular shaft and a second end of the second tubular shaft.

17. The method of claim 15, wherein the second linkage is located on an opposite side of the continuous column relative to the first linkage.

18. The method of claim 15, wherein the first column pressure block has a rectangular shape.

19. The method of claim 15, wherein the first column pressure block includes a curved surface configured to contact the continuous column and a flat surface configured to contact the first continuous beam.

20. The method of claim 15, wherein the first linkage comprises a rod linkage.

* * * * *